US009327148B2

(12) United States Patent
Holoch et al.

(10) Patent No.: US 9,327,148 B2
(45) Date of Patent: May 3, 2016

(54) DRIVE FOR FIRE DAMPER

(75) Inventors: Philip Holoch, Neschwil (CH); Marc Thuillard, Uetikon am See (CH)

(73) Assignee: BELIMO Holding AG, Hinwil (CH)

( * ) Notice: Subject to any disclaimer, the term of this patent is extended or adjusted under 35 U.S.C. 154(b) by 1279 days.

(21) Appl. No.: 13/147,752

(22) PCT Filed: Feb. 3, 2010

(86) PCT No.: PCT/CH2010/000027

§ 371 (c)(1),
(2), (4) Date: Nov. 3, 2011

(87) PCT Pub. No.: WO2010/099630

PCT Pub. Date: Sep. 10, 2010

(65) Prior Publication Data

US 2012/0037713 A1 Feb. 16, 2012

(30) Foreign Application Priority Data

Mar. 2, 2009 (CH) ..... 307/09

(51) Int. Cl.

| | |
|---|---|
| ***A62C 2/12*** | (2006.01) |
| ***A62C 2/24*** | (2006.01) |
| *F24F 11/00* | (2006.01) |

(52) U.S. Cl.

CPC . *A62C 2/247* (2013.01); *A62C 2/12* (2013.01); *A62C 2/242* (2013.01); *F24F 2011/0098* (2013.01)

(58) Field of Classification Search

CPC ..... A62C 2/12; A62C 2/242; A62C 2/247; F24F 2011/0095; F24F 2011/0098

USPC ..... 236/49.2

See application file for complete search history.

(56) References Cited

U.S. PATENT DOCUMENTS

| | | | | |
|---|---|---|---|---|
| 3,912,223 | A * | 10/1975 | Iwata | F16K 17/386 126/285 R |
| 4,432,272 | A * | 2/1984 | Vans Becelaere | A62C 2/14 236/49.2 |
| 4,540,980 | A | 9/1985 | Porco | |
| 4,545,363 | A | 10/1985 | Barchechat et al. | |
| 5,123,875 | A | 6/1992 | Eubank et al. | |
| 5,533,929 | A * | 7/1996 | Attridge, Jr. | A62C 2/24 137/79 |
| 5,728,001 | A | 3/1998 | Attridge et al. | |
| 5,779,540 | A | 7/1998 | Nailor | |
| 6,224,481 | B1 | 5/2001 | McCabe | |
| 6,711,470 | B1 * | 3/2004 | Hartenstein | F24F 11/0017 236/49.3 |

FOREIGN PATENT DOCUMENTS

| | | |
|---|---|---|
| BE | 1 001 873 A4 | 4/1990 |
| CN | 2480650 Y | 3/2002 |

* cited by examiner

*Primary Examiner* — Jonathan Bradford
(74) *Attorney, Agent, or Firm* — Sughrue Mion, PLLC

(57) ABSTRACT

A drive apparatus (1) for a fire damper (2) having an electric drive (10), which holds the fire damper in a normal position when power is supplied and moves it into a safety position when no power is supplied. A thermal contact breaker (12) interrupts the power supply to the drive (10) at a melt temperature. The drive apparatus (1) also has a temperature sensor (13) for measuring the air temperature (T), a gas sensor (14) for measuring the content (G) of fumes in the air, and a switch module (15), which interrupts the power supply depending on the values of T and G. In the event of a fire, the fire damper can thus be moved into a safety position not only when the temperature in the region of the thermal contact breaker (12) is high, but already when smoke or gas develops as a result of the fire.

15 Claims, 3 Drawing Sheets

DRIVE FOR FIRE DAMPER

CROSS REFERENCE TO RELATED APPLICATIONS

This application is a National Stage of International Application No. PCT/CH2010/000027 filed Feb. 3, 2010, claiming priority based on Switzerland Patent Application No. 00307/09 filed Mar. 2, 2009, the contents of all of which are incorporated herein by reference in their entirety.

TECHNICAL FIELD

The present invention relates to a drive apparatus for a fire damper and to a method for operating the fire damper using an electric drive. The present invention in particular relates to a drive apparatus for a fire damper and to a method for operating the fire damper using an electric drive, which is designed to hold the fire damper in a normal position during a supply of current and to move said fire damper into a safety position when there is no supply of current, for example a spring-return drive.

PRIOR ART

Fire dampers are installed in buildings for preventing fire and smoke from being transported in ventilation ducts, for example in walls and ceilings between sections of the building. When the functioning as a smoke and fire barrier, the fire damper is open in the normal position during normal operation in order to enable air to pass through in the ventilation duct and is closed in the safety position in the event of a fire in order to prevent the fire and smoke being transported through the ventilation duct. Depending on the ventilation and smoke extraction concept, however, it is conversely also possible to configure a fire damper as a smoke damper, which is open in the safety position in the event of a fire in order to enable smoke to be extracted through the ventilation duct, but is closed in the normal position during normal operation. The fire dampers are each brought automatically into the safety position by a thermal release. The thermal release comprises fusible solder, which fuses at a predetermined fusing temperature, for example at 72° C., and as a result acts as a thermal cutout, which interrupts a circuit. In the case of a fire damper with an electric drive and spring return, the thermal cutout interrupts the supply of current to the drive, with the result that the fire damper is moved automatically out of the normal position mechanically into the safety position by virtue of the spring return when there is no feed to the drive in the event of a fire. Fire dampers with thermal cutouts have the disadvantage, however, that they respond relatively slowly and therefore often prevent the spread of smoke in the building to an unsatisfactory extent or even not at all. In addition, it is always necessary to ensure that a thermal cutout has intact (unfused) fusible solder in order to be able to prevent the spread of a fire through the ventilation ducts in the event of a fire, which requires manual or automated checking and possibly manual replacement of the thermal cutout. Fire dampers with thermal cutouts have the further disadvantage that they are entirely unsuitable for heat testing, which is carried out periodically and in automated fashion.

BE 1 001 873 describes a damper with a gas or smoke sensor.

U.S. Pat. No. 5,728,001 describes a damper with a plurality of sensors, which can each individually trigger the closure of the damper by virtue of interrupting the supply of current. In addition to a temperature sensor, in particular a smoke or gas sensor is also provided, which triggers the closure of the damper at lower temperatures than the temperature sensor.

DESCRIPTION OF THE INVENTION

An object of the present invention is to propose a drive apparatus for a fire damper and a method for operating the fire damper which do not have at least some disadvantages of the known systems. An object of the present invention is in particular to propose a drive apparatus for a fire damper and a method for operating the fire damper which, at least in certain fire scenarios, make it possible to move the fire damper more quickly over to the safety position than conventional systems with thermal cutouts based on fusible solder.

In accordance with the present invention, these aims are achieved in particular by the elements in the independent claims. Further advantageous embodiments are also given in the dependent claims and the description.

The drive apparatus for a fire damper comprises an electric drive, for example a spring-return drive, which is designed to hold the fire damper in a normal position during a supply of current and to move said fire damper into a safety position when there is no supply of current.

The abovementioned aims are achieved by the present invention in particular by virtue of the fact that the drive apparatus is provided with a temperature sensor for measuring an air temperature value and a gas sensor for measuring a content of combustion gases in the air and comprises a switch module, which is connected to the temperature sensor and the gas sensor and is designed to interrupt the supply of current depending on the air temperature value and the content of combustion gases (or on a variable which is dependent on the content, for example a gradient or another defined function of the content) in the air. That is to say that the fire damper can be brought into the safety position depending on a combination of air temperature and content of combustion gases in accordance with defined conditions with respect to the pair of values comprising the air temperature and the content of combustion gases. In comparison with systems with thermal cutouts, the fire damper can therefore not be brought into the safety position in the event of a fire when the temperature prevailing at the thermal cutout is high, but possibly even earlier in the case of a development of smoke or gas caused by the fire, i.e. in the case of a specific combination of air temperature and content of combustion gases in the air. That is to say that, in comparison with conventional systems, more selective and, in many situations, quicker detection of fires is enabled. The gas sensor is, for example, a VOC (volatile organic compound) sensor for measuring a content of volatile organic compounds in the air.

In one variant embodiment, the drive apparatus also comprises a thermal cutout with a fusible solder, which is designed to interrupt the supply of current to the drive at a specific fusing temperature. The switch module is preferably arranged in series with the thermal cutout. The switch module comprises in particular a switch which is arranged in series with the thermal cutout for interrupting the supply of current, and the switch module is designed to generate a switching signal, which is dependent on the air temperature value and the content of combustion gases, for controlling the switch. That is to say that, in comparison with conventional systems, more selective and, in many situations, quicker detection of fires is enabled, without the reliability of a thermal cutout based on fusible solder being lost in the process when the switch module has a defect, for example.

In a variant embodiment, the switch module is designed to interrupt the supply of current depending on a value for the content of combustion gases, said value having been modulated by the air temperature value. That is to say that the measured value for the content of combustion gases is changed depending on the air temperature value measured and the supply of current is interrupted depending on this changed value for the content of combustion gases.

In a variant embodiment, the switch module is designed to determine a gas limit value depending on the air temperature value, and to interrupt the supply of current in the event of a content of combustion gases which is above this gas limit value. That is to say that, depending on the measured air temperature value, a numerical limit value for combustion gases is defined and the supply of current is interrupted when the measured content of combustion gases is above this limit value.

Preferably, the switch module is designed to interrupt the supply of current in the event of an air temperature value which is in a defined temperature range depending on a defined function of air temperature value and content of combustion gases. In this case, it is presupposed for an interruption that there is a higher content of combustion gases at a temperature value in a lower part of the temperature range than comparatively for a higher temperature value in an upper part of the temperature range. In other words, as the air temperature value increases, the gas limit value decreases and a lower content of combustion gases is sufficient for causing an interruption. When the air temperature value is lower than a lower range limit of the temperature range, the switch module does not trigger an interruption. This prevents the possibility of the presence of combustion gases on their own, for example as a result of the evolution of gases from articles such as packaging material, furniture or carpets, causing an interruption when there is no fire and therefore no development of heat. On the other hand, the switch module triggers an interruption when the air temperature value is higher than an upper range limit of the temperature range. This ensures that the fire damper is moved into the safety position when the fire is developing heat but is not generating any combustion gases in the process. If, in the event of a fire, no interruption is brought about by the switch module, for example owing to a defect in the switch module or one of the associated sensors, or in the event of a short circuit in the wiring of the switch module, the interruption is triggered in the variant with the thermal cutout at the fusing temperature of the fusible solder.

In a further variant embodiment, the drive apparatus comprises a signaling module, which is connected to the gas sensor and is designed to generate a control signal for controlling a supply of fresh air depending on the content of combustion gases (or on a variable dependent on the content, for example a gradient or another defined function of the content). As a result, the gas sensor is used not only for controlling the fire damper, but also efficiently for controlling the supply of fresh air.

BRIEF DESCRIPTION OF THE DRAWINGS

An embodiment of the present invention will be described below with reference to an example. The exemplary embodiment is illustrated by the following attached figures.

APPROACHES FOR IMPLEMENTING THE INVENTION

Figure 1:
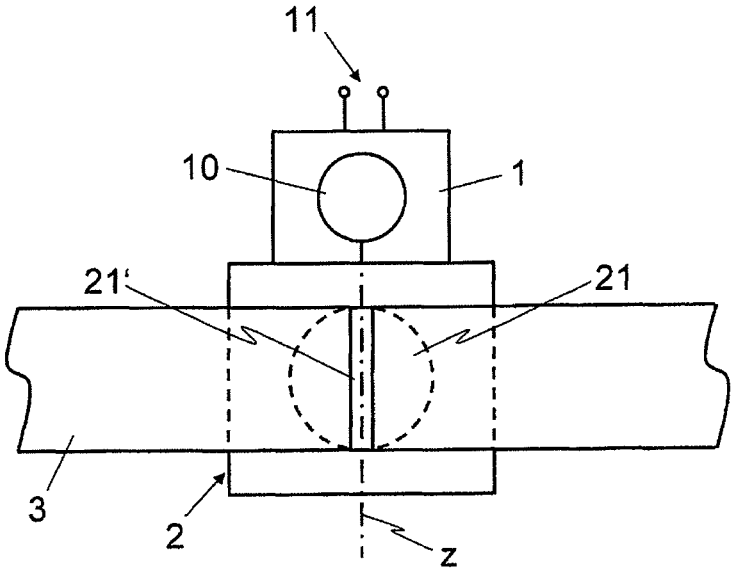
FIG. 1 shows, schematically in cross section, a fire damper which is connected on both sides to a ventilation duct and has a drive apparatus.

In FIG. 1, the reference symbol 2 denotes a fire damper, which is connected on both sides to a ventilation duct 3, for example a tube with a round or rectangular cross section. The fire damper 2 can also be used as a smoke damper. The passage through the ventilation duct 3 is controlled by setting a damper element 21, 21' of the fire damper 2, said damper element being capable of rotating about an axis of rotation z. The damper element 21, 21' is moved or held in position by the drive apparatus 1, which is connected to the fire damper 2. The drive apparatus 1 preferably comprises an electric drive (motor) 10, which is in the form of a spring-return drive. In the case of a configuration as a fire damper 2, the damper element or the fire damper 2 is held in the open position (normal position) by the drive 10 to which a voltage 11 is applied during normal operation, as indicated by the reference symbol 21. In the event of a fire, the supply of current to the drive 10 is interrupted and the damper element or the fire damper 2 is brought into the closed position (safety position) by a spring of the drive 10, as is indicated by the reference symbol 21'. In the case of a configuration as a smoke damper 2, the damper element 21 or the fire damper 2 is held in the closed position (normal position) by the drive 10, to which a voltage 11 is applied during normal operation, whereas in the event of a fire the damper element 21 or the fire damper 2 is brought into the open position (safety position) when the supply of current is interrupted.

Figure 2:
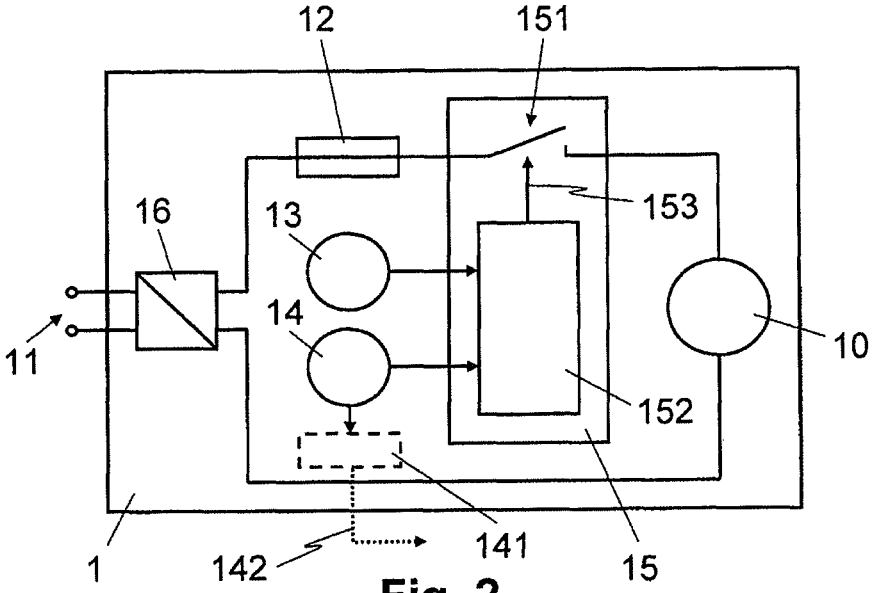
FIG. 2 shows a block diagram which illustrates a drive apparatus with a drive, with a thermal cutout and a switch module connected upstream of said drive.
Figure 3:
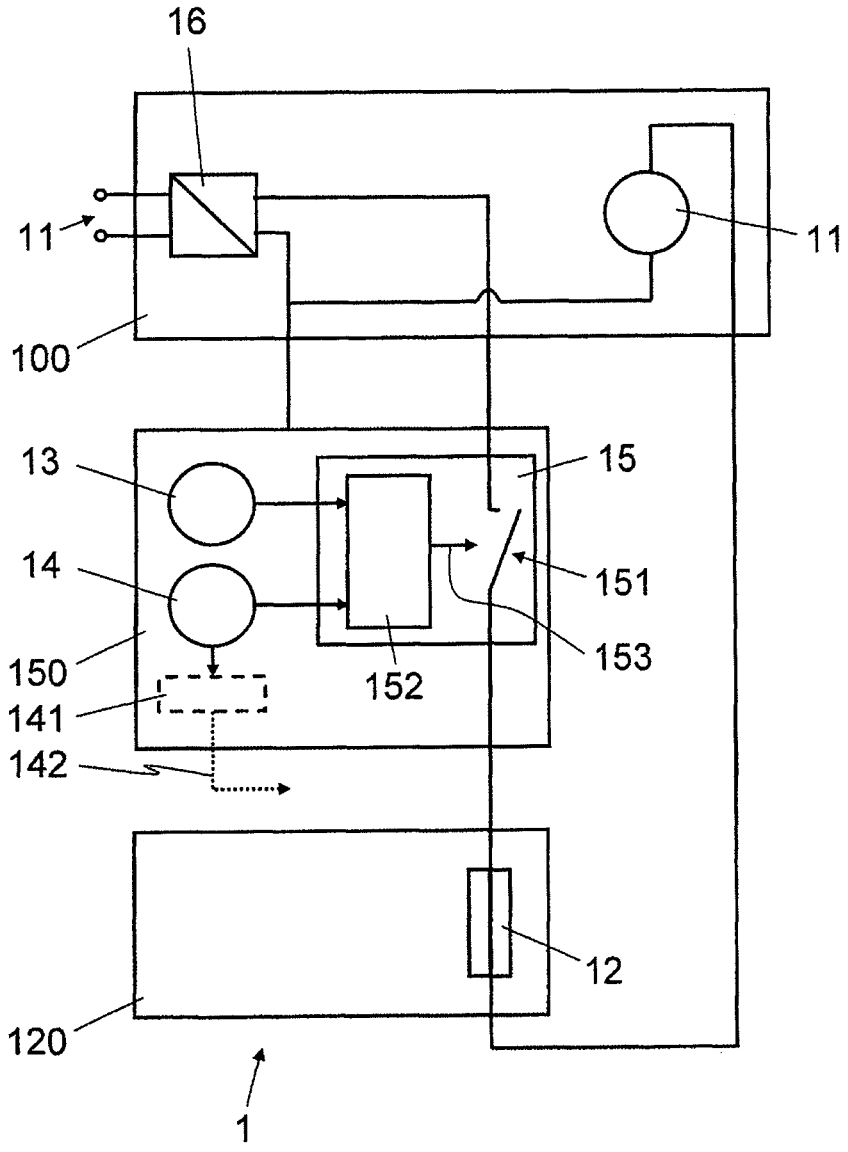
FIG. 3 shows a block diagram which illustrates a drive apparatus with a drive, with a thermal cutout and a switch module being connected upstream of said drive as modules with separate housing.

As is illustrated in FIGS. 2 and 3, the drive apparatus 1 comprises an optional switched mode power supply 16 for matching the feed voltage 11 to the operating voltage used by the drive 10. The drive apparatus 1 moreover comprises an optional thermal cutout 12 with a replaceable fusible solder, which fuses at a defined fusing temperature of 72° C., for example, and interrupts the supply of current to the drive 10. In one variant embodiment, the drive apparatus 1 comprises a plurality of thermal cutouts 12, which can be installed at various positions.

In addition, the drive apparatus 1 comprises a switch module 15 with a switch 151, which is connected in series with the thermal cutout 12 in the feed line to the drive 10. Furthermore, the drive apparatus 1 comprises a temperature sensor 13 for measuring an air temperature value and a gas sensor 14 for measuring a content of combustion gases in the air, for example a VOC sensor for measuring a content of volatile organic compounds in the air. The temperature sensor 13 is a titanium resistance sensor, for example. The gas sensor 14 is a metal semiconductor sensor, for example, for measuring the content of CO, $H_2$ and/or $C_xH_y$ in the air.

The temperature sensor 13 and the gas sensor 14 are connected to the logic module 152 and to the switch module 15, respectively. In one variant embodiment, the drive apparatus 1 comprises a plurality of temperature sensors 13 and/or gas sensors 14, which are connected to the logic module 152 and to the switch module 15, respectively, and which can be installed at different positions. The logic module 152 generates a switching signal 153 for controlling the switch 151 on the basis of the air temperature value measured by the temperature sensor 13 and the content of combustion gases measured by the gas sensor 14. The logic module 152 implements a function, which is dependent on the air temperature value and the content of combustion gases, for controlling the switch 151 and therefore the interruption of the supply of current to the drive 10.

TABLE 1

| Temperature T | Content G (or variable derived therefrom) of combustion gases | Switching signal |
|---|---|---|
| $T < T_L$ (e.g. T < 35° C.) | independent | On (No interruption) |
| $T = T_L$ (e.g. T = 35° C.) | $G \geq G_L$ | Off (Interruption) |
| $T_L < T < T_H$ (e.g. 35° C. < T < 82° C.) | $G \geq G_{LIM}(T)$ | Off (Interruption) |
| $T \geq T_H$ (e.g. T ≥ 82° C.) | independent | Off (Interruption) |

As illustrated in table 1 and FIG. 5, the switch 151 is switched on in the event of an air temperature value T below a lower range limit $T_L$ of the temperature range $T_R=[T_L, T_H]$ independently of the content G of combustion gases in the air (for example at T<35° C.), i.e. the supply of current to the drive 10 is not interrupted.

In the case of an air temperature value T at the lower range limit $T_L$, the switch 151 is switched off (for example T=35° C.), and therefore the supply of current to the drive 10 is interrupted when the content G of combustion gases reaches at least a lower gas limit value $G_L$.

In the case of an air temperature value T within the defined temperature range $T_R=(T_L, T_H)$, the switch 151 is switched off (for example at 35° C.<T<82° C.), when the content G of combustion gases reaches at least a gas limit value $G_{LIM}(T)$ which is dependent on the air temperature value T. The function $G_{LIM}(T)$ which is dependent on the air temperature value T for calculating the gas limit value is defined, for example, as a mathematical function (curve) and calculated (in real time), or is determined by a table of stored pairs of values.

In the case of an air temperature value T at or above the upper range limit $T_H$, the switch 151 is switched off independently of the content G of combustion gases (for example at T≥82° C.), and therefore the supply of current to the drive 10 is interrupted.

Figure 5:
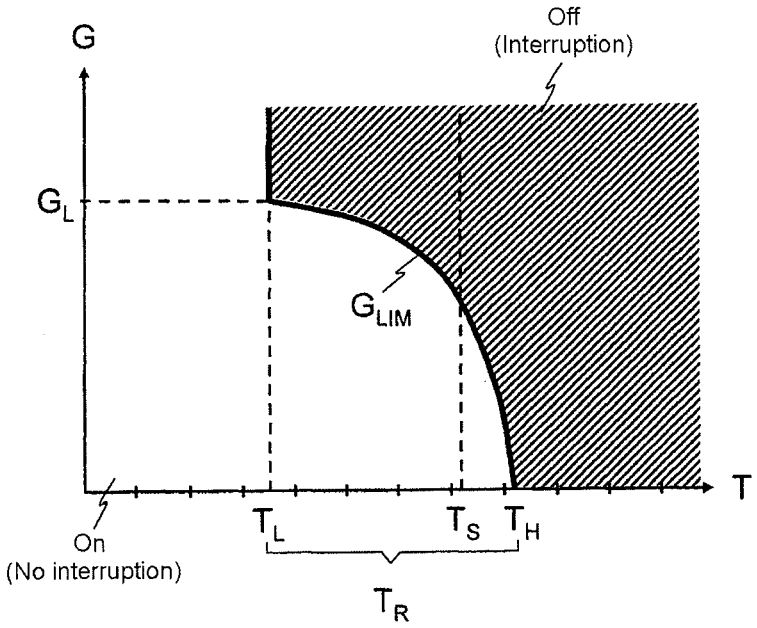
FIG. 5 shows an example of a function for interrupting the supply of current to the drive of the fire damper, depending on air temperature and content of combustion gases in the air.

FIG. 5 illustrates the air temperature values T and the values of the content G of combustion gases in the air at which the switch 151 is switched off by the logic module 152 and the supply of current to the drive is therefore interrupted. FIG. 5 also shows the defined fusing temperature $T_S$ of the fusible solder of the thermal cutout 12, for example 72° C. Given a sufficiently high content G of combustion gases ($G \geq G_{LIM}(T)$), the supply of current to the drive 10 is thus interrupted even for air temperature values $T<T_S$, below the fusing temperature $T_S$ of the fusible solder, and therefore the fire damper 2 is brought into the safety position more quickly than by a thermal cutout 12 on its own. Even at air temperature values $T \geq T_S$, at or above the fusing temperature $T_S$ of the fusible solder, the supply of current to the drive 10 is interrupted more quickly or the safety position is reached more quickly given a sufficiently high content G of combustion gases ($G \geq G_{LIM}(T)$), than by a thermal cutout 12 on its own since the thermal cutout 12 is relatively slow and does not interrupt the supply of current immediately. In the event of a malfunction of the switch module 15, for example owing to a defective component in the logic module 152 or a defect in the switch 151, or in the event of a short circuit in the wiring of the switch module 15 or the switching apparatus 150 (see FIG. 3), the thermal cutout 12 ensures that the supply of current is nevertheless interrupted in the event of a fire when the fusible solder fuses and the fire damper 2 is brought into the safety position.

Depending on the variant embodiment, the logic module 152 is in the form of an electronic circuit with discrete electronic component parts, in the form of an application-specific integrated circuit (ASIC) or by means of a programmed processor, for example. In the latter case, the logic module 152 therefore comprises a programmed software module which is run on the processor. In order to generate the switching signal 153 for the switch 151, the logic module 152 modulates the measured value for the content of combustion gases for example by means of the air temperature value before it is compared with a defined gas limit value and/or the logic module 152 determines a gas limit value depending on the measured air temperature value and compares this determined gas limit value with the measured content of combustion gases.

In one variant embodiment, the drive apparatus 1 also comprises a signaling module 141, which is connected to the gas sensor 14 and is designed to generate a control signal 142 for controlling a supply of fresh air depending on the measured content of combustion gases. The control signal 142 is supplied to a ventilation damper via a signal line, for example.

Figure 4:
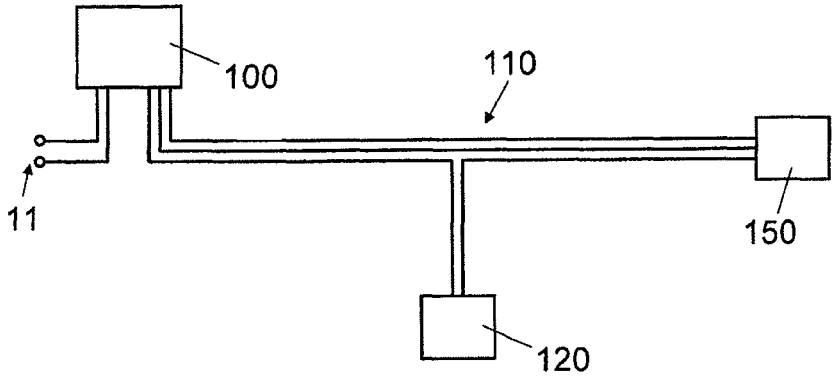
FIG. 4 shows a block diagram which illustrates an example of wiring for a modularized embodiment of the drive apparatus.

A person skilled in the art will be aware of the fact that the components of the drive apparatus 1 illustrated in FIG. 2 can be arranged in separate apparatus modules with in each case a dedicated housing, depending on the variant embodiment. For example, the drive apparatus 1 in accordance with the variant embodiment shown in FIG. 3 is arranged in different separate modules each having a dedicated housing. The drive 10 is arranged in a drive module 100; the switch module 15 is arranged together with the temperature sensor 13 and the gas sensor 14 in a switching apparatus 150 with a separate housing; and the thermal cutout 12 is arranged in a safety apparatus 120 with a separate housing. The components of the drive module 100, the switching apparatus 150 and the safety apparatus 120 are in this case connected to one another via wiring 110, as is illustrated schematically in FIG. 4 using an example.

The invention claimed is:

1. A drive apparatus (1) for a fire damper (2), comprising:

an electric drive (10), which is designed to hold the fire damper (2) in a normal position with a supply of current and to move said fire damper into a safety position when there is no supply of current, a temperature sensor (13) for measuring an air temperature value (T), a gas sensor (14) for measuring a content (G) of combustion gases in the air, and a switch module (15), which is connected to the temperature sensor (13) and the gas sensor (14) and is designed to detect signals representing the measured value T and the measured value G and to interrupt the supply of current when there is a predetermined combination of both the air temperature value (T) and the content (G) of combustion gases in the air.

2. The drive apparatus (1) as claimed in claim 1, wherein the switch module (15) is designed to interrupt the supply of current depending on a combination of the air temperature value (T) and the content (G) of combustion gases in the air in accordance with defined conditions with respect to the pair of values comprising the air temperature value (T) and the content (G) of combustion gases.

3. The drive apparatus (1) as claimed in claim 1, wherein the drive apparatus (1) comprises a thermal cutout (12) with fusible solder, said thermal cutout being designed to interrupt the supply of current to the drive (10) at a fusing temperature, in that the switch module (15) comprises a switch (151), which is arranged in series with the thermal cutout (12), for interrupting the supply of current, and in that the switch module (15) is designed to generate a switching signal (153), which is dependent on the air temperature value (T) and on the content (G) of combustion gases, for controlling the switch (151).

4. The drive apparatus (1) as claimed in claim 1, wherein the switch module (15) is designed to interrupt the supply of current depending on a value for the content (G) of combustion gases, said value having been modulated by the air temperature value (T).

5. The drive apparatus (1) as claimed in claim 1, wherein the switch module (15) is designed to determine a gas limit value ($G_{LIM}$) depending on the air temperature value (T), and to interrupt the supply of current in the event of a content (G) of combustion gases which is above the gas limit value ($G_{LIM}$).

6. The drive apparatus (1) as claimed in claim 1, wherein that the switch module (15) is designed to interrupt the supply of current in the event of an air temperature value (T) which is in a defined temperature range ($T_R$) depending on a defined function of the air temperature value (T) and the content (G) of combustion gases.

7. The drive apparatus (1) as claimed in claim 1, further comprising a signaling module (141), which is connected to the gas sensor (14) and is designed to generate a control signal (142) for controlling a supply of fresh air depending on the content (G) of combustion gases.

8. The drive apparatus (1) as claimed in claim 1, wherein the gas sensor (14) comprises a VOC sensor for measuring a content of volatile organic compounds in the air.

9. A method for operating a fire damper (2) with an electric drive (10), which holds the fire damper (2) in a normal position during a supply of current and moves said fire damper into a safety position when there is no supply of current, comprising:

measuring an air temperature value (T), measuring a content (G) of combustion gases in the air, and detecting the measured value T and the measured value G by a switch, wherein the supply of current to the drive (10) is interrupted by the switch (151) when there is a predetermined combination of both the air temperature value (T) and the content (G) of combustion gases in the air.

10. The method as claimed in claim 9, wherein the supply of current to the drive (10) is interrupted by the switch (151) depending on a combination of the air temperature value (T) and the content (G) of combustion gases in the air in accordance with defined conditions with respect to the pair of values comprising the air temperature value (T) and the content (G) of combustion gases.

11. The method as claimed in claim 9, wherein a switching signal (153), which is dependent on the air temperature value (T) and on the content (G) of combustion gases, is generated for controlling the switch (151).

12. The method as claimed in claim 9, wherein the supply of current is interrupted depending on a value for the content (G) of combustion gases, said value having been modulated by the air temperature value (T).

13. The method as claimed in claim 9, wherein a gas limit value ($G_{LIM}$) is determined depending on the air temperature value (T), and in that the supply of current is interrupted in the event of a content (G) of combustion gases which is above the gas limit value ($G_{LIM}$).

14. The method as claimed in claim 9, wherein the supply of current is interrupted in the event of an air temperature value (T) which is in a defined temperature range ($T_R$) depending on a defined function of the air temperature value (T) and the content (G) of combustion gases.

15. The method as claimed in claim 9, wherein a control signal (142) is generated for controlling a supply of fresh air depending on the content (G) of combustion gases.

* * * * *